US007331131B2

(12) United States Patent
Staples

(10) Patent No.: US 7,331,131 B2
(45) Date of Patent: Feb. 19, 2008

(54) DISPLAY ASSEMBLY FOR A VEHICLE

(76) Inventor: Terrance Staples, 2508 Jethro Ave., Zion, IL (US) 60099

( * ) Notice: Subject to any disclaimer, the term of this patent is extended or adjusted under 35 U.S.C. 154(b) by 280 days.

(21) Appl. No.: 11/120,793

(22) Filed: May 3, 2005

(65) Prior Publication Data

US 2006/0272188 A1 Dec. 7, 2006

(51) Int. Cl.
*G09F 19/08* (2006.01)

(52) U.S. Cl. ..... 40/413; 40/439; 446/177; 446/199; 428/31

(58) Field of Classification Search ..... 40/439, 40/412, 413, 538, 591, 424; 446/177, 199; 428/31

See application file for complete search history.

(56) References Cited

U.S. PATENT DOCUMENTS

| | | | | |
|---|---|---|---|---|
| D51,976 | S | 4/1918 | Uttz | |
| D61,294 | S | 8/1922 | Frishmuth | |
| D61,403 | S | 8/1922 | Tuomey | |
| D65,260 | S | 7/1924 | Frishmuth | |
| D72,934 | S | 6/1927 | Chéron-Duval | |
| 1,644,051 | A | 10/1927 | Campbell | |
| D74,656 | S | 3/1928 | Borden et al. | |
| D76,635 | S | 10/1928 | Woller | |
| 1,821,609 | A | 9/1931 | Baker | |
| 2,049,360 | A * | 7/1936 | Erickson | 40/413 |
| 2,076,530 | A | 4/1937 | Eastman | |
| D114,358 | S | 4/1939 | Wilson | |
| 2,302,672 | A * | 11/1942 | Buckley | 40/413 |
| 2,564,213 | A * | 8/1951 | Redhead | 40/413 |
| 2,632,269 | A | 3/1953 | Sanders | |
| 2,998,799 | A * | 9/1961 | Placek | 428/31 |
| 3,840,285 | A * | 10/1974 | Vandermeer | 40/591 |
| 3,946,509 | A | 3/1976 | McCaffrey | |
| D244,184 | S | 5/1977 | Kubitskey | |
| 4,546,562 | A * | 10/1985 | Jones | 40/591 |
| 4,928,954 | A | 5/1990 | Levine et al. | |
| 5,665,438 | A * | 9/1997 | Lee et al. | 428/31 |
| 6,041,534 | A * | 3/2000 | Buhler | 40/591 |
| 6,106,912 | A | 8/2000 | Balog | |
| 6,578,300 | B2 * | 6/2003 | Anderson et al. | 40/591 |
| 6,588,133 | B1 * | 7/2003 | Garrity | 40/591 |
| 6,688,027 | B2 | 2/2004 | Fink | |
| 2004/0134108 | A1 * | 7/2004 | Harari | 40/591 |

* cited by examiner

*Primary Examiner*—Gary C. Hoge
(74) *Attorney, Agent, or Firm*—Fitch, Even, Tabin & Flannery

(57) ABSTRACT

A display assembly for removably mounting to a vehicle. The display assembly includes a base member having opposite end portions and an accessory item having a predetermined configuration such that when the vehicle reaches a sufficient speed the accessory item rises a distance above an adjacent surface of the vehicle. The display assembly includes a releaseable connection between the accessory item and an end portion of the base member.

10 Claims, 5 Drawing Sheets

DISPLAY ASSEMBLY FOR A VEHICLE

FIELD OF THE INVENTION

The invention relates to a display assembly for mounting to a vehicle, and more particularly, to a display assembly to personalize a vehicle having an accessory item and a base member.

BACKGROUND

Adding accessories to a vehicle provides an owner the ability to personalize or customize their vehicle. Often, many owners chose to add accessory items on their vehicle to make it unique, to make a statement, or to present a humorous image. For example, personalized license plates, bumper stickers, graphics, or interior display items are common ways an owner may personalize a vehicle, such as a car. Other similar items may be used to personalize a watercraft, motorcycle, bicycle, or other vehicles. In many cases, however, the vehicle owner wishes a non-permanent accessory to temporarily customize the vehicle appearance. In that regard, various signs, plush figures, fuzzy dice, stickers, inflatable items, air fresheners, or flags are common accessories that are temporarily mountable to a vehicle surface.

SUMMARY OF THE INVENTION

A display assembly for removably mounting to a vehicle is provided. The display assembly includes a base member for being removeably mounted to a vehicle and an accessory item having a predetermined configuration so that with the vehicle reaching a sufficient speed the accessory item rises a distance above an adjacent surface of the vehicle. Therefore, the accessory item appears to be flying over the vehicle surface and hanging onto the vehicle. In addition, to enhance the visual effect of the display assembly, the base member is preferably transparent so that it visually blends into the vehicle; as a result, upon viewing the display assembly that is removeably mounted to the vehicle, the accessory item is immediately apparent rather than the base member.

In one form, the base member is removeably mounted to the vehicle. In that regard, the base member, which is preferably a flexible sheet, includes first and second securing devices on opposite end portions of the base member. Each of the securing devices detachably mounts a corresponding end portion of the base member to the vehicle. In one form, the first securing device may be either a suction cup or a magnet and the second securing device may be a resilient member that is clampable in a space formed between an edge of a first vehicle surface and an edge of an adjacent, second vehicle surface. Therefore, upon the resilient member being clamped in such a manner to removeably mount one end portion of the base member to the vehicle, the flexible sheet may be folded over an edge of the first vehicle surface such that the base member then generally conforms to the first vehicle surface. In this configuration, the first securing device may then secure the other end portion of the base member to the first vehicle surface.

In another aspect, the accessory item has a predetermined configuration, which may be an airfoil shape or an incline portion. In that regard, the accessory item preferably takes on a humanoid form that includes a torso and at least one arm that extends downwardly from the torso. In this arrangement, the predetermined configuration may be the at least one downwardly extending arm that presents a portion of the accessory item inclined to an incoming airflow, which may generate lift to rise the accessory item above the vehicle surface. In other arrangements, the humanoid form further includes outwardly extended legs along with the at least one downwardly extended arm. In this arrangement, the predetermined configuration is a generally airfoil shape formed by the outwardly extended legs and the downwardly extended arms, which may also generate lift to rise the accessory item above the vehicle surface. To hold the predetermined configuration, the accessory item also preferably includes a lightweight strengthening member, which may have a portion embedded within the accessory item. While it is preferred that the accessory item is the humanoid form, the accessory item may also be other shapes, such as an animal form, a flag, a sports object, an airplane shape, or a body portion.

The display assembly also includes a releaseable connection, which preferably includes a cooperating hook member and a loop member. In one form, the hook member is on one of the end portions of the base member and the loop member is on a distal end of the accessory item. The releaseable connection secures the accessory item to the base member, but also allows the accessory item to be removed from the base member without the base member being demounted from the vehicle. In this manner, the accessory item may be easily changed without removing and remounting the base member to the vehicle.

DESCRIPTION OF THE PREFERRED EMBODIMENTS

Figure 1:
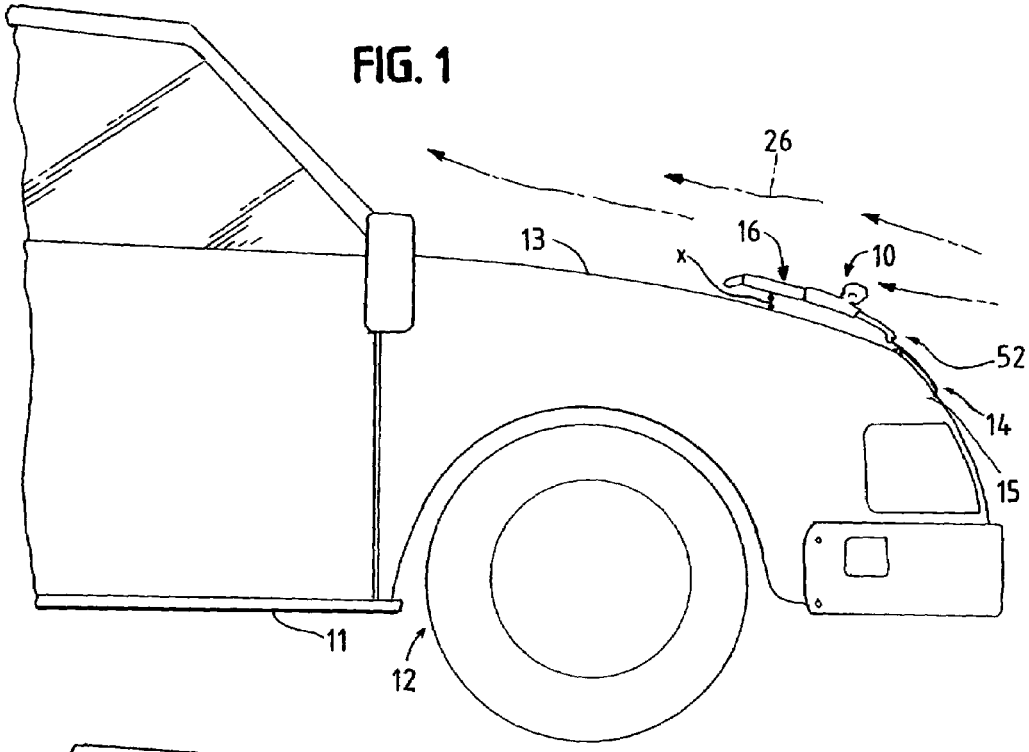
FIG. 1 is a side elevational view of a display assembly embodying features of the present invention shown mounted to an exemplary vehicle; the display assembly is illustrated in the raised position.
Figure 2:
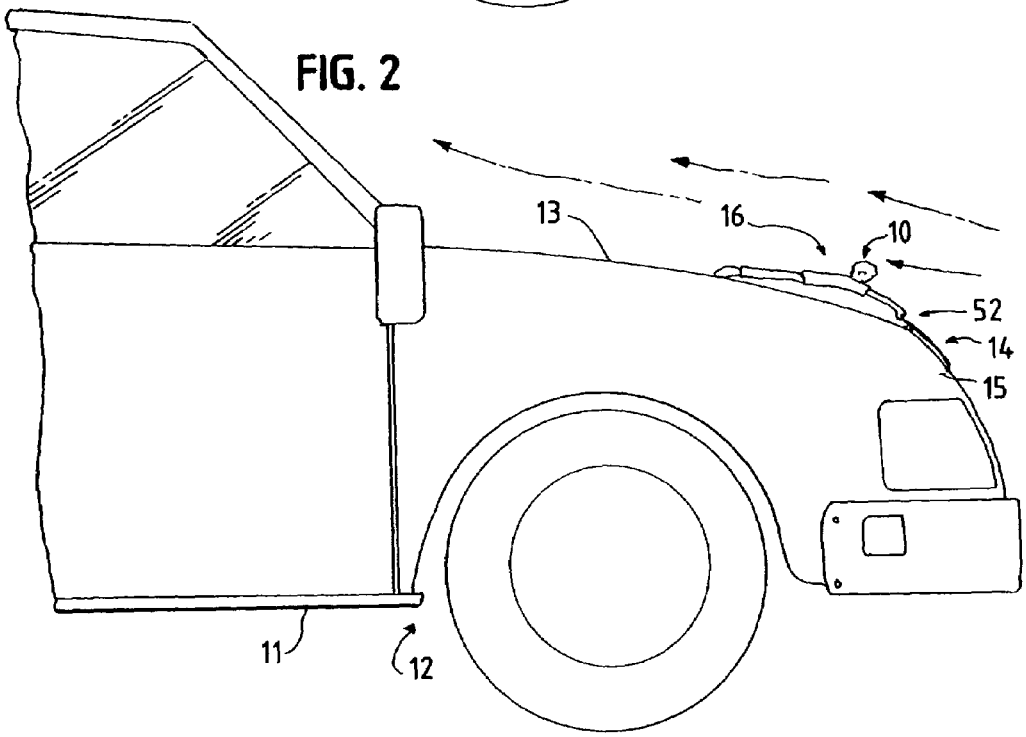
FIG. 2 is the display assembly of FIG. 1 illustrated in the rest position.

Referring to FIGS. 1-2, a display assembly 10 for mounting to an exemplary vehicle 12 is illustrated that embodies features of the present invention. While the display assembly 10 is shown mounted to an automobile 11, the display assembly 10 may be mounted to any vehicle 12, such as a car, boat, motorcycle, bicycle, stroller, or the like.

In general, display assembly 10 includes a base member 14, an accessory item 16, and a releaseable connection 52. The accessory item 16 is preferably a humanoid character 58; however, as further discussed below, the accessory item 10 may also be other shapes, forms, or objects. In one aspect, the base member 14 is configured to releaseably mount to a vehicle surface 13 and have the accessory item 16 detachably or releaseably connected to the base member 14. In this arrangement, as further discussed below, the accessory item 16 can be interchanged without having to remove the base member 14 from the vehicle 12.

Figure 5:
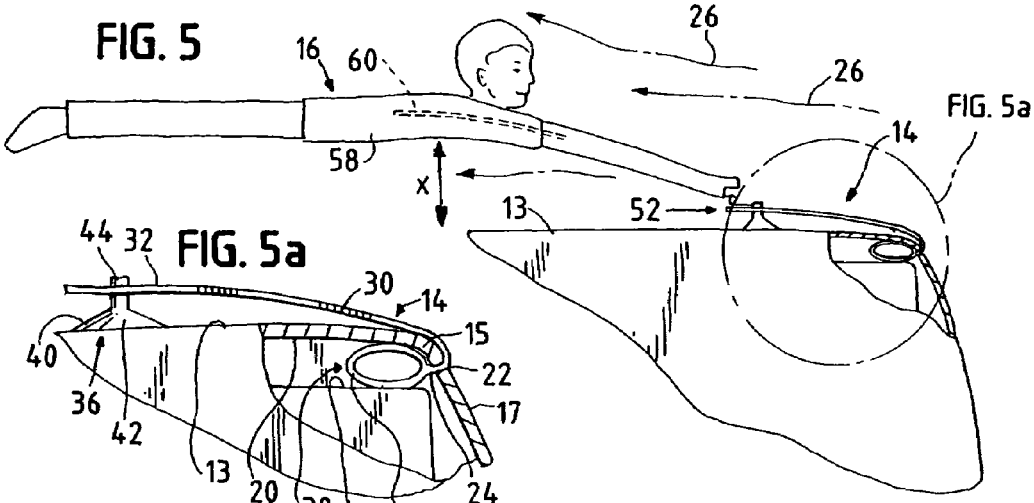
FIG. 5 is a detailed side elevational view of the display assembly of FIG. 1.

The accessory item 16 has a predetermined configuration that allows the item 16 to move from a first position contacting the vehicle surface 13 (FIG. 2) to a second position elevated a distance X above the vehicle surface 13 (FIGS. 1 and 5) upon a sufficient motion of the vehicle 12 or upon a sufficient airflow 26 over the surface 13. More specifically, when initially mounted to the vehicle 12, the accessory item 16 is in the rest position. That is, the accessory item 16 is resting on or contacting the surface 13 of the vehicle 12 as illustrated in FIG. 2. The display assembly 10 is in the resting position when the vehicle 12 is either not moving or only moving at a slow rate of speed such that either no airflow or an airflow at a low level is flowing over the vehicle surface 13. On the other hand, when the vehicle 12 increases in speed such that a sufficient airflow 26 passes over the vehicle surface 13, then the accessory item 16 raises or elevates the distance X over the surface 13 to the second position above the vehicle surface 13 as illustrated in FIGS. 1 and 5. In this manner, when in the second position, the accessory item 16 appears to fly over the vehicle surface. Moreover, in the preferred embodiment, the humanoid character 58 in such position appears to be hanging onto the moving vehicle 12.

Referring to FIG. 5, the accessory item 16 preferably has a shape or configuration such that the accessory item 16 interacts with the airflow 26 to rise above the vehicle surface 13 upon the vehicle 12 reaching a sufficient speed or upon engaging a sufficient airflow 26. For example, the accessory item 16 may rise up to about three inches above the vehicle surface 13 upon the vehicle reaching a speed of about 35 to about 45 miles per hour. Nevertheless, depending on the vehicle 12 speed or the airflow 26 velocity, the accessory item 16 may elevate more or less distance X over the vehicle surface 13. Moreover, the height X that the accessory item 16 elevates above the surface 13 and the sufficient speed necessary to achieve such height X depends on many factors, such as the weight of the accessory item, the size of the accessory item, the shape of the accessory item, the ambient conditions, the shape of the surface 13, or the like.

Referring to FIGS. 3-6, the accessory item 16 will now be described in more detail. While the accessory item 16 may be any number of different shapes, in a preferred embodiment, the accessory item 16 is the humanoid form 58 generally having an outstretched shape with a torso 58*a*, rearwardly extended legs 58*b*, at least one outwardly extended arm 58*c*, and at least one hand portion 58*d*. Joined to a distal end of the at least one outwardly extended arm 58*c* is a portion of the releasable connection 52. In a most preferred embodiment, the humanoid character 58 has two arms 58*c* that each extend in a downwardly fashion away from the torso 58*a*. In this predetermined configuration, the accessory item 16 has a portion (i.e., the arms 58*c*) with a downward angle or an incline into the incoming airflow 26. In other predetermined configurations, the accessory item 16 may form a generally airfoil shape. That is, the downward extending arms 58*a* and the rearwardly extending legs 58*b* may configure the profile of the accessory item 16 into the generally airfoil shape. While not wishing to be limited by theory, it is believed that this downward angle in some embodiments or the generally airfoil shape in other embodiments helps the accessory item 16 to elevate the distance X above the vehicle surface 13 when the vehicle 12 reaches the sufficient speed.

Figure 7:
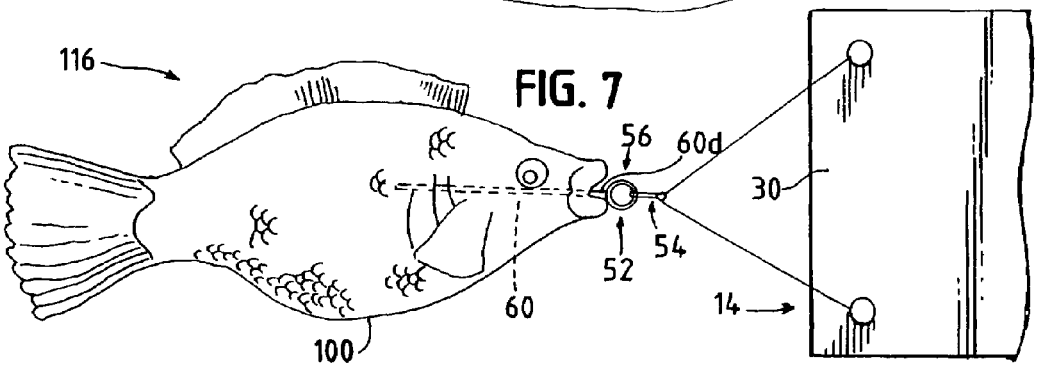
FIG. 7 is a top plan view of an alternative display assembly embodying features of the present invention, the alternative display assembly includes an alternative accessory item.

While the accessory item 16 is illustrated as a humanoid form, the accessory item 16 may also embody other shapes or forms. For instance, the accessory item 16 may resemble an animal, a flag, a sports object, an airplane, or various body portions, such as a hand or foot. For example, FIG. 7 shows an alternative embodiment of an accessory item 116 in the form of a fish 100, which may also be releaseably connected to the base member 14.

The accessory item 16 may be fabricated out of any formable, lightweight material that can be shaped in the desired form. Preferably, the accessory item 16 is constructed from an expanded polyethylene or other lightweight foam; however, other suitable lightweight materials may be used as well. The desired shape of the accessory item 16 may be fabricated using any method known in the art to form the desired shape out of the selected material; however, a suitable method of fabricating the accessory item 16 from the polyethylene is an injection molding process using a mold of the desired accessory item 16 shape. Optionally, the accessory item 16 may also be decorated, painted, or include other items such as clothing, costumes, capes, hats, flowing hair, or the like. As part of a theme, the accessory item 16 may further include other objects such as briefcases, sports parfanellia, backpacks, umbrellas, skis, or the like. In other forms, the accessory item 16 may also include movable portions, have illuminated features, include lightening devices such as LEDs, include glow in the dark sections, or other features to enhance the visual effect of the accessory item 16.

The accessory item 16 preferably includes a strengthening member 60, which may be embedded within the accessory item 16. The strengthening member 60 provides support to the accessory item 16, prevents the polyethylene or other material from separating from the releaseable connection 52, and may hold the accessory item 16 in the desired predetermined configuration. In that regard, the strengthening member 60 may be any material that is lightweight, rigid, and bendable, such as a wire, thin rod, metal strip, or the like. Preferably, the strenghtening member 60 is a stainless steel wire. The same wire 60 may be used to form the loop 56.

Figure 3:
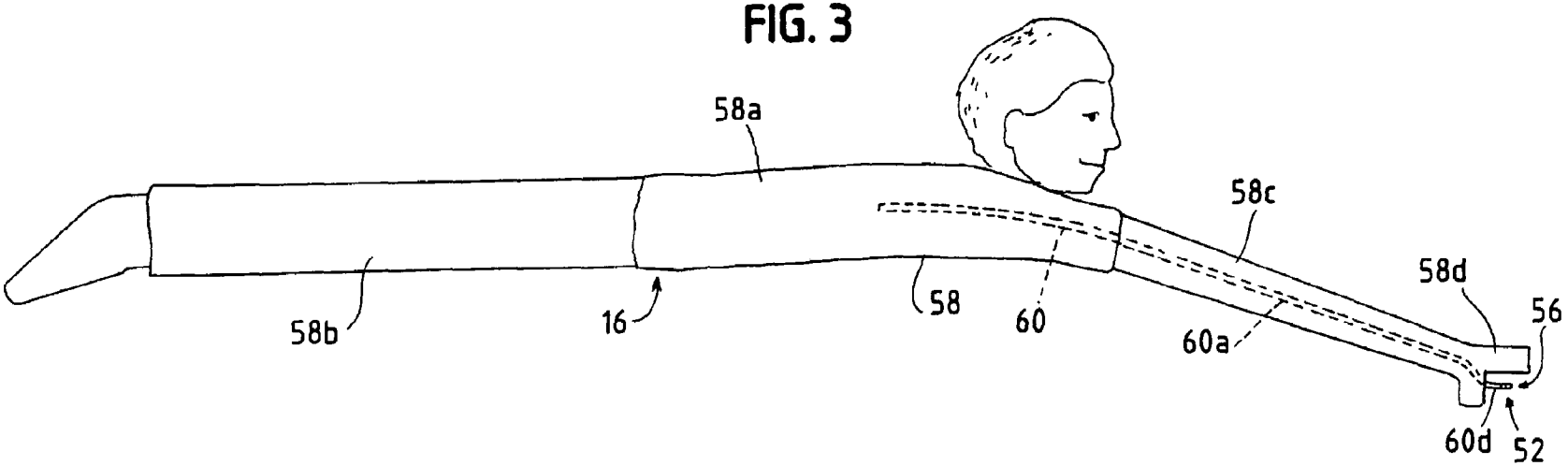
FIG. 3 is a side elevational view of an exemplary accessory item for the display assembly of FIG. 1.
Figure 4:
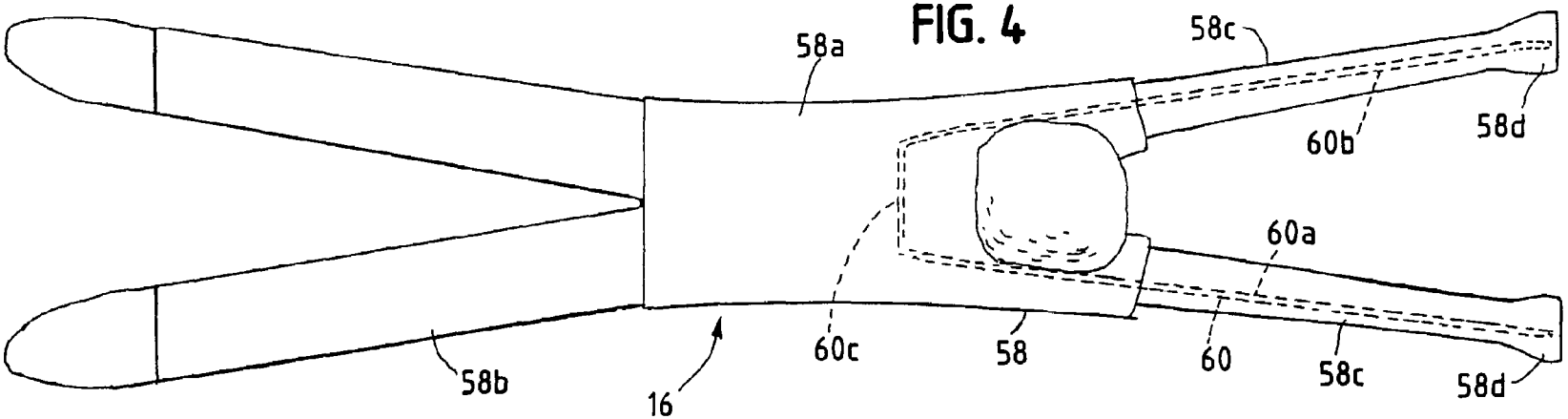
FIG. 4 is a top plan view of the accessory item of FIG. 3.

As illustrated in FIG. 3, the strengthening member 60 may include two arm portions 60*a* and 60*b* joined by a traverse portion 60*c*, all of which are preferably embedded in the accessory item 16. Alternatively, as illustrated in FIG. 7, the strengthening member 60 may include only a single portion, as illustrated by the single strengthening member embedded within the accessory item 116. The strengthening member 60, in addition, may also include an end portion 60*d*, which is not embedded within the accessory item 16. The end portion 60*d* generally extends outwardly a short distance from a distal end portion of at least one of the arms 58*c*. This non-embedded, end portion 60*d* is for joining the strengthening member 60 to the releaseable connection 52, as will be further described below.

In the preferred embodiment, the strengthening member 60 is embedded in the arms and torso of the humanoid form 58. That is, each arm portion 60*a* and 60*b* of the strengthening member 60 is generally embedded within one of the arms 58*c* and the traverse portion 60*c* of the strengthening member 60 is embedded within the torso 58*a*. In this configuration, the strengthening member 60 provides support for the outwardly extended arms 58*c* and may also form the arms 58*c* in the downwardly angle away from the torso or may hold the action FIG. 16 in the generally airfoil shape.

As indicated above, the accessory item 16 also includes a portion of the releasable connection 52. More specifically, the accessory item 16 includes a loop member 56. The loop member 56 generally includes an eyelet portion 56*a* and a shank portion 56*b*. The shank portion 56*b* is connected, joined, or secured to the end portion 60*d* of the strengthening member 60. As best illustrated in FIGS. 3 and 5, in one form, the loop member 56 is generally covered by the hand portion 58*d* of the humanoid form 58; therefore, when releaseably connected to the base member 14, the humanoid form 58 appears to be grasping the base member 14. It is also preferred that the humanoid form 58 includes a pair of the loop members 56, each of which extend from a distal end of one of the arms 58*c*. As will be further described below, the loop member 56 releaseably connects the accessory item 16 to the base member 14, which also includes another portion of the releaseable connection 52.

It is preferred that the loop member 56 be a thin gauge wire or the like, such as stainless steel. The loop member 56 should be strong enough to releasably connect the accessory item 16 to the base member 14, but also thin enough such that the loop member 56 has minimized visibility. That is, the humanoid character should preferably appear to be grasping the vehicle, not held on by the loop member 56.

Figure 8:
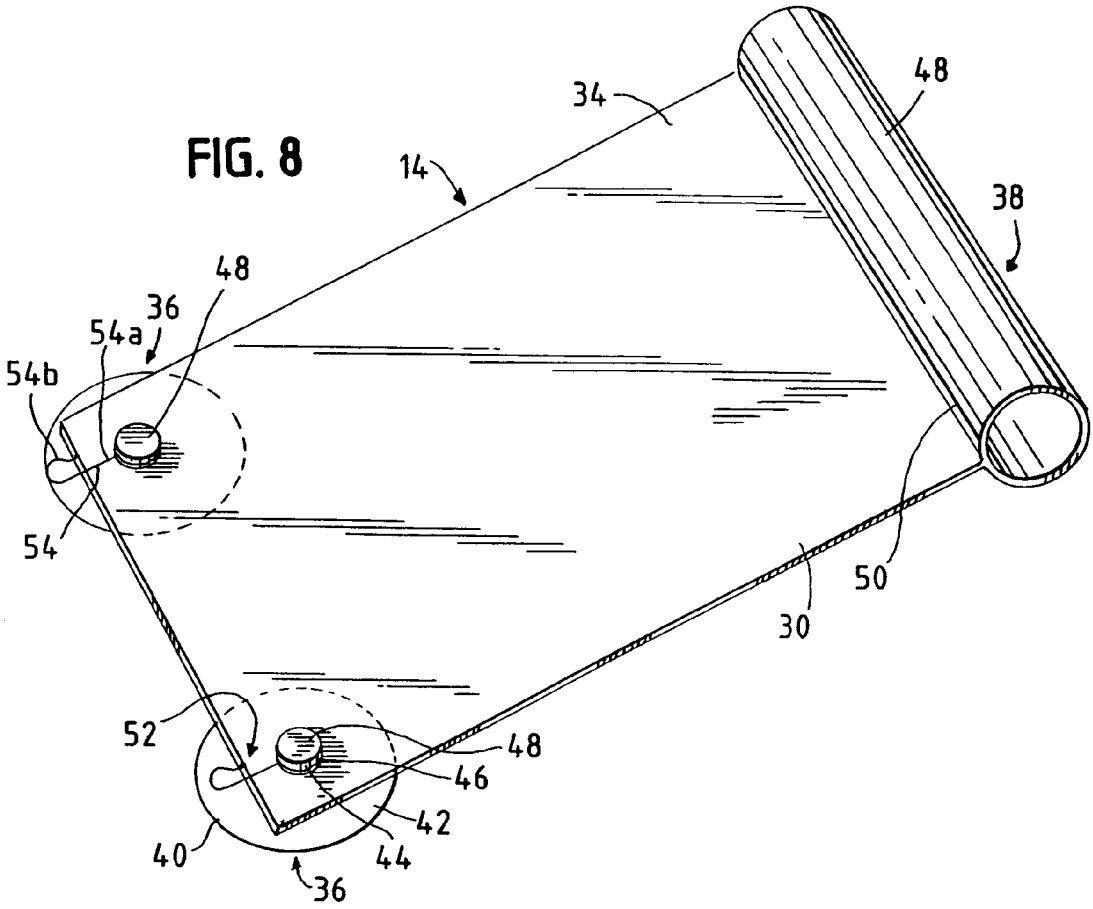
FIG. 8 is a perspective view of a base member for the display assembly of FIG. 1.
Figure 9:
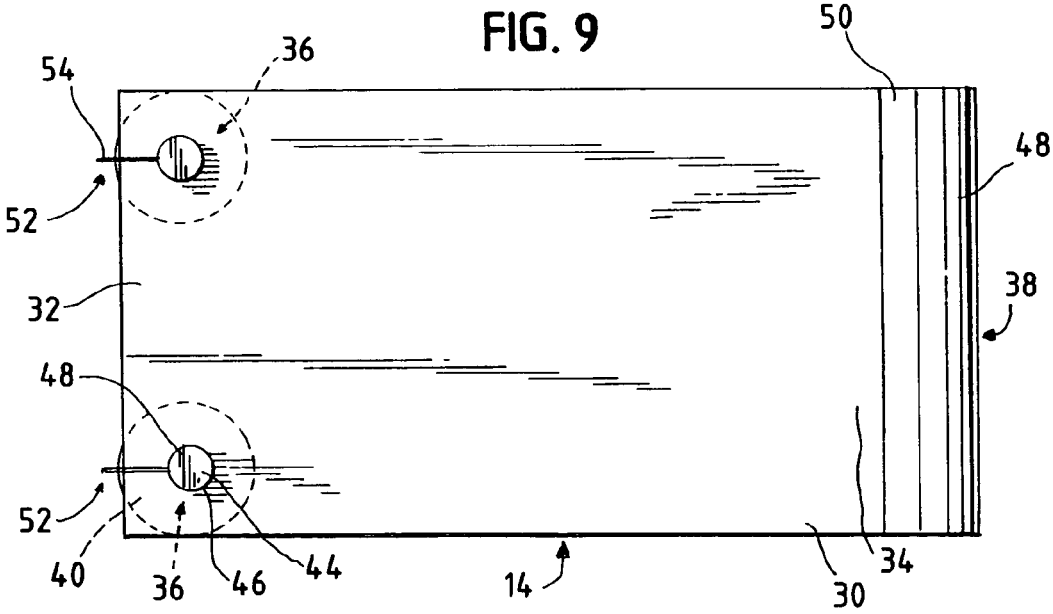
FIG. 9 is a top plan view of the base member of FIG. 8.

Referring now to FIGS. 8-9, one embodiment of the base member 14 will be described in more detail. In general, the base member 14 includes a sheet 30 having opposite end portions 32 and 34, at least one first securing device 36, and at least one second securing device 38. In one form, the base member 14 preferably includes a pair of securing devices 36 disposed at the end portion 32 and, most preferably, at the corners of the end portion 32. The combination of the first securing device 36 and the second securing device 38 removeably mount the end portions 32 and 34 of the base member 14 to the vehicle 12.

More specifically, the sheet 30 is preferably a flexible sheet that is both conformable to the vehicle surface 13 and, as further described below, bendable around a leading edge 15 of the vehicle surface 13. Additionally, it is preferred that sheet 30 is a clear, transparent, or translucent material such that, when the base member is removeably mounted to the vehicle 12, the vehicle 12 is visible through the sheet 30. Therefore, when the display assembly 10 is removeably mounted to the vehicle 12, only the accessory item 16 is immediately visible because the sheet 30 of the base member 14 blends with vehicle surface 13. Accordingly, sheet 30 may be any clear, flexible, bendable material. Preferably, the sheet 30 is a clear, flexible sheet of PVC plastic. In a most preferred embodiment, sheet 30 is a sheet of clear PVC six inches wide by twelve inches long and is 3⁄32 inches thick.

In the embodiment of FIGS. 8 and 9, the first securing device 36 is preferably a suction cup 40 having a lower cup portion 42, an integral upper boss portion 44, and an enlarged cap 48 disposed on top of the boss portion 44. The suction cup 40 is joined to the sheet 30 through apertures 46 that are preferably disposed in the corners of the end portion 32. Specifically, in one form, the boss 44 is frictionally inserted through the apertures 46 and retained therein via the enlarged cap 48 on the top portion of the boss 44; however, other methods to secure the suction cup 40 to the sheet 30 known in the art may also be used. The suction cup 40 may be any known type of suction cup, but is preferably formed from clear flexible PVC plastic. As will be more further described below, the first securing device 36 removeably mounts the end portion 32 of the base member 14 to the vehicle 12.

The second securing device 38 is preferably a resilient tube 48 joined to the end portion 34. In this form, the second securing device 38 removeably mounts the end portion 34 of the base member 14 to the vehicle 12. The resilient tube 48 may be any resilient material that is compressible, yet retains its original shape upon removal of the compression force. Accordingly, the resilient tube 48 is preferably a clear PVC tube having a thickness of about 3⁄32 of an inch and a diameter of about one and a half inches. In a preferred embodiment, the resilient tube 48 is secured to the end portion 34 at an edge 50 of the sheet 30 through a bond, an adhesive, a glue, a heat weld, or any other suitable securing method known in the art.

The base member 14 also includes another portion of the releaseable connection 52. More specifically, the base member 14 preferably includes a hook member 54. The hook member 54 generally includes a shank portion 54*a* and a looped end portion 54*b*. While only a single hook member 54 may be used, it is preferred that the base member 14 include a pair of the hook members 54 that correspond to the loop members 56. In one arrangement, the pair of hook members 54 are spaced apart such that each hook member 54 is generally disposed in a corner of the end portion 32. While the hook member 54 may be joined to the base member 14 using any method known in the art, it is preferred to join each hook member 54 to one of the first securing devices 36. That is, the shank 54*a* may be embedded in the boss 44 or the hook structure may have an eyelet (not shown) such that the eyelet encircles the boss 44 just below the cap 48. The hook member 54 releaseably connects with the corresponding loop structure 56 of the accessory item 16, which will be further described below. Similar to the loop member 56, the hook member 54 is preferably a thin gage wire, such as stainless steel. Additionally, it is also preferred that the hook member 54 have minimized visibility for similar reasons as the loop member 56.

Figure 5A:
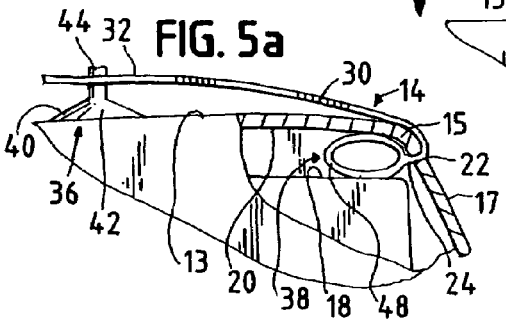
FIG. 5*a* is a detailed view of the display assembly of FIG. 1 removeably mounted to the exemplary vehicle.

Now that the components of one embodiment of the base member have been described, the releaseable mounting of the base member to the vehicle surface 13 will be explained in more detail. Referring to FIGS. 5 and 5*a*, in a preferred embodiment, each end portion 32 and 34 is releaseably mounted to the vehicle 12. More specifically, the resilient member 48 of the end portion 34 is releasably mounted to the vehicle 12 by being clamped, secured, compressed or otherwise closed within a space 22 formed between two adjacent vehicle surfaces 13 and 17. For instance, the first vehicle surface 13, such as a hood, may be opened to expose a top inner surface 18 of a radiator or other engine component near the front of the vehicle 12. The resilient member 48 is placed on the top inner surface 18 with the end portion 32 extending outwardly away from the vehicle 12 in an orientation with the cup portion 42 of the suction cups 40 facing upwardly. The open vehicle surface 13 is then closed, which clamps or compresses the resilient member 48 between the inner top surface 18 and an inner surface 20 of the first vehicle surface 13. In this arrangement, the sheet 30 extends outwardly through the space 22 between the leading edge 15 of the first vehicle surface 13 and an edge 24 of the adjacent second vehicle surface 17. Therefore, the resilient member 48 is compressed or squeezed between the surface 20 and the surface 18 to releaseably mount the end portion 34 to the vehicle 12. In a similar fashion, the end portion 34 may be releaseably mounted to other vehicle surfaces, such as doors, trunks, lids, covers, or the like.

Once the end portion 34 is mounted to the vehicle 12 as described above, then the end portion 32 may be releaseably mounted to the first vehicle surface 13. To mount the end portion 32, the sheet 30 is folded or bent backwardly over the leading edge 15 in a configuration such that the sheet 30 generally conforms to the first vehicle surface 13. In this configuration, the cup portion 42 of the suction cups 40 are now downwardly facing and oriented to mount the end portion 32 to the vehicle surface 13. As is known in the art, the suction cups 40 are secured to the vehicle surface 13 by placing downward pressure on the boss 44 of the suction cup 40 to secure the cup portion 42 to the vehicle surface 13 via vacuum pressure. When mounted to the vehicle in this manner, the hook members 54 extend outwardly away from the end portion 32 positioned to accept the corresponding loop members 56 of the accessory item 16, as will be further described below.

Figure 10:
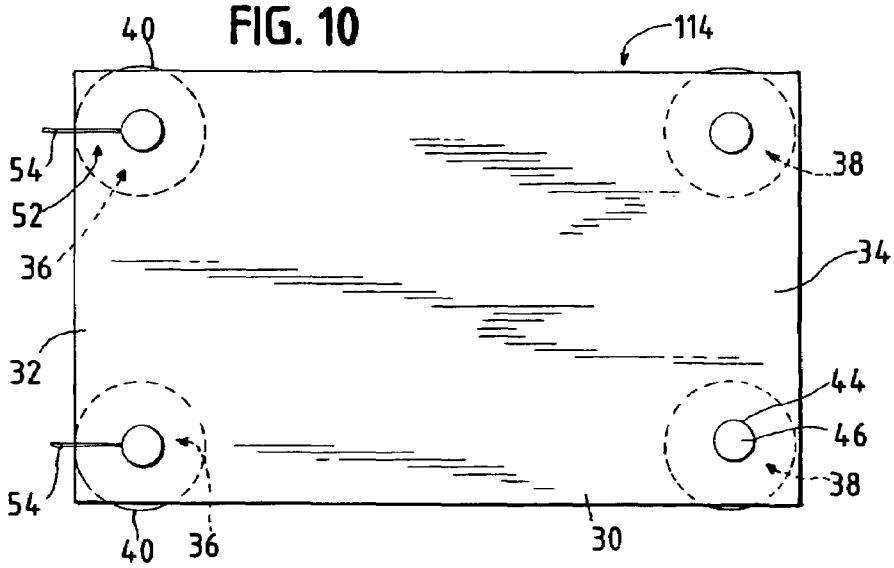
FIG. 10 is a top plan view of an alternative base member for the display assembly of FIG. 1.
Figure 11:
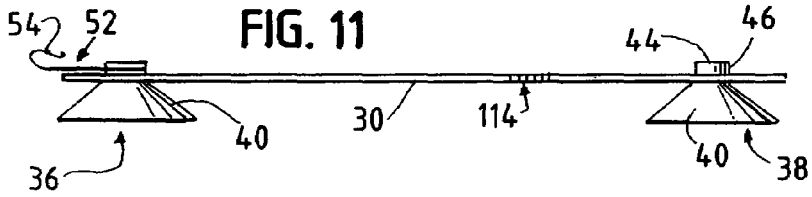
FIG. 11 is a side elevational view of the alternative base member of FIG. 10.

Referring to FIGS. 10-13, two alternative embodiments of the base member 14 are illustrated that embody features of the present invention. For example, FIGS. 10 and 11 illustrate a base member 114 formed from the sheet 30 that is similar to base member 14, but includes a pair of suction cups 40 as the second securing device 38 as well as a pair of the suction cups 40 as the first securing device 36. In this form, when the suction cup 40 is also used as the second securing device 38, it is joined to the base member 114 is a similar fashion as previously described. That is, the boss 44 of the suction cup 40 is inserted through an aperture 46 in the end portion 34. The second securing device 38, on the other hand, generally does not need to include a portion of the releaseable connection 52 because the end portion 34 does not generally connect to the accessory item 16. That is, if the suction cup 40 is used as the second securing device 36, then the suction cup 40 generally does not include the loop member 54.

In this embodiment, the base member 114 secures both end portion 32 and end portion 34 to the vehicle surface 13 via the suction cups 40 on both end portions. Therefore, rather than having the end portion 34 clamped between two abutting vehicle surfaces, both end portions 32 and 34 are releaseably mounted to the vehicle surface 13 via the suction cups 40.

Figure 12:
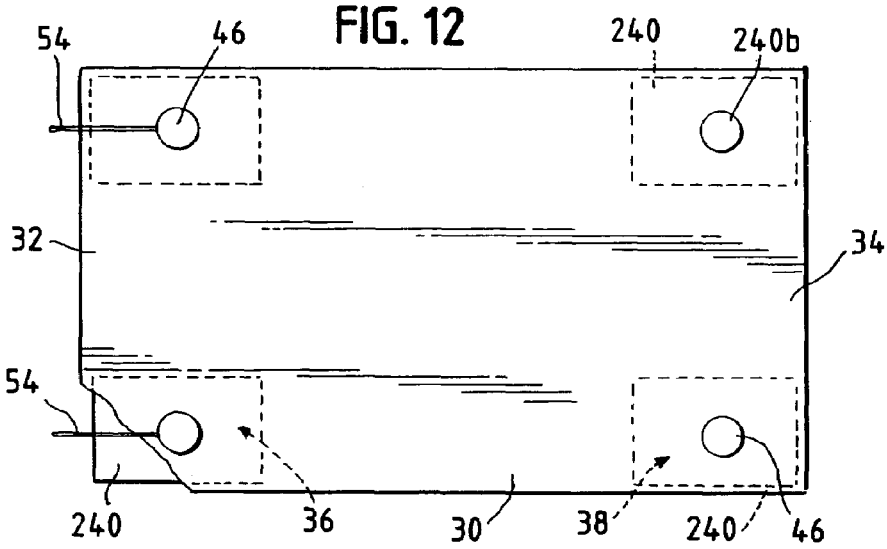
FIG. 12 is a top plan view of another alternative base member for the display assembly of FIG. 1.
Figure 13:
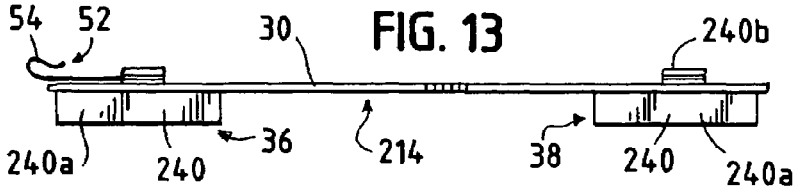
FIG. 13 is a side elevational view of the alternative base member of FIG. 12.

FIGS. 12 and 13 illustrate base member 214, which is another alternative embodiment of the base member 14. The base member 214 also includes the flexible sheet 30, but includes magnetic structures 240 as the first securing device 36 as well as the second securing device 38. The magnetic structures 240 generally include at least a magnetic portion 240*a* and a boss 240*b*. Preferably, the boss 240*b* joins the magnetic structures 240 to the base member 214 in a similar fashion as the boss 44 of the suction cups 40 by extending through apertures 46 in the base member 214. As with the previous embodiment, the base member 214 includes apertures 46 in both end portions 32 and 34 to accept the boss 240*b* of each of the magnetic structures 240. The magnetic portion 240*a* allows each end portion 32 and 34 of the base member 214 to be releasably mounted to any magnetic surface, such as an automobile outer panel. In this configuration, both of the end portions 32 and 34 of the base member 214 are releasably mounted to the vehicle surface 13 rather than the end portion 34 being clamped between two adjacent vehicle surfaces.

As previously described, the display assembly 10 includes a releasable connection 52. While the releaseable connection 52 has been previously described as including the hook member 54 and the loop member 56, other releaseable connecting structures may also be used to connect the accessory item 16 to the base member 14. For instance, the releaseable connection 52 may also include clamps, buttons, grips, slots, or other demountable connecting structures known in the art. Moreover, the prior discussion described the hook member 54 on the base member 14 and the loop member 56 on the accessory item 16, but a reverse configuration is also desirable.

Figure 6:
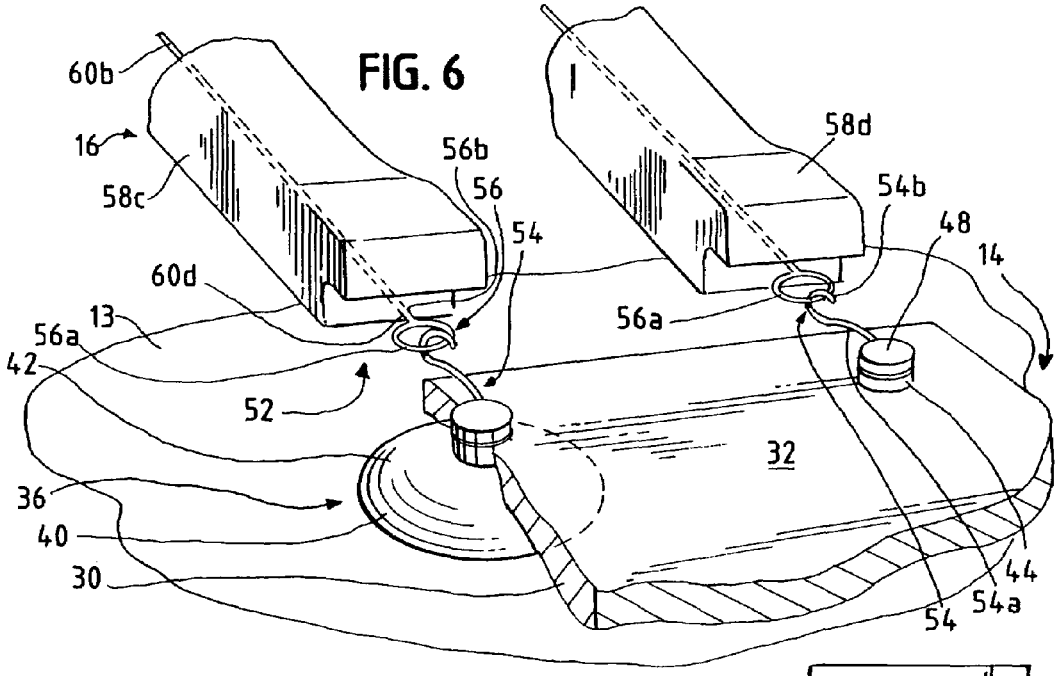
FIG. 6 is a detailed perspective view of a releaseable connection for the display assembly of FIG. 1.

Referring to FIG. 6, the preferred cooperation of the hook member 54 and the loop member 56 will be described in more detail. The hook member 54 cooperates with the loop member 56 to releaseably connect the accessory item 16 to the base member 14. More specifically, the hook portion 54*b* is inserted through the eyelet portion 56*a*. In this manner, the accessory item 16 is releaseably connected to the base member 14 because, in the general direction of the airflow 26, the hook portion 54*b* secures the accessory item 16 to the base member 14. However, the accessory item 16 is also releaseable from the base member 14 because the accessory item 16 can be tilted forwardly such that the hook portion 54*b* may be slid outward from the eyelet portion 56*a* to remove the accessory item 16 from the base member 14.

The releaseable connection 52 provides flexibility to the display assembly 10 by allowing the base member 14, 114, or 214 to be releaseably mounted to the vehicle surface 13, as described previously, and also allowing alternative accessory items 16 to be releaseably connected to the base member 14, 114, or 214 as desired without removing such base member from the vehicle 12. For instance, once the base member 14 is mounted to the vehicle 12, the humanoid form 58 may be connected to the base member 14 via the releaseable connection 52. Then, without demounting the base member 14 from the vehicle 12, the humanoid form 58 may be removed from the base member 14 and, for example, the fish shape 100 may be connected to the base member 14 via the same releaesable connection 52. However, as suggested above, many other shapes or forms may be connected to and removed from the base member in a similar fashion.

It will be understood that various changes in the details, materials, and arrangements of parts and components which have been herein described and illustrated in order to explain the nature of the invention may be made by those skilled in the art within the principle and scope of the invention as expressed in the appended claims.

What is claimed is:

1. A display assembly for removably mounting to a vehicle, the display assembly comprising:

a base member having opposite end portions;

a first securing device at one of the end portion of the base member for detachably mounting the one end portion to the vehicle;

a second securing device at the opposite end portion of the base member for detachably mounting the opposite end portion to the vehicle;

an accessory item having a predetermined configuration so that with the vehicle reaching a sufficient speed the accessory item rises above an adjacent surface of the vehicle;

a releaseable connection between the accessory item and either end portion of the base; and wherein the base member has a generally thin, flat configuration and one of the first and second securing devices comprises an enlarged, resilient compressible securing member for allowing the base member to be fit between two adjacent surfaces of the vehicle with the securing member sized to be resiliently compressed between the vehicle surfaces with the other of the first and second securing devices operable to detachably mount the corresponding base member end to the vehicle.

2. The display assembly of claim 1, wherein the predetermined configuration of the accessory item comprises an airfoil shape.

3. The display assembly of claim 1, wherein the accessory item is a humanoid form further comprising a torso and at least one arm, the at least one arm extending downwardly from the torso wherein the predetermined configuration is the at least one downwardly extending arm such that the accessory item has a portion inclined to an incoming airflow.

4. The display assembly of claim 1, wherein the accessory item is a humanoid form further comprising outwardly extended legs, a torso, and at least one arm extended downwardly from the torso wherein the predetermined configuration is a generally airfoil shape formed by the outwardly extended legs and the downwardly extended arms.

5. The display assembly of claim 1, wherein the releaseable connection comprises a cooperating hook member and a loop member.

6. The display assembly of claim 5, wherein the hook member is on one of the end portions of the base member and the loop member is on a distal end of the accessory item.

7. The display assembly of claim 6, wherein the accessory item comprises a lightweight strengthening member having a first end joined to the loop member and a portion embedded in the accessory item wherein the strengthening member forms the predetermined configuration.

8. The display assembly of claim 1, wherein the accessory item is selected from the group consisting of a humanoid form, an animal form, a flag, a sports object, an airplane shape, and a body portion.

9. The display assembly of claim 1, wherein the first securing device is selected from the group consisting of a suction cup and a magnet and wherein the second securing device is a resilient member clampable in a space formed between an edge of a first vehicle surface and an edge of an adjacent second vehicle surface.

10. The display assembly of claim 9, wherein the base member is a flexible sheet such that upon the resilient member being clamped in the space between the adjacent vehicle surfaces, the flexible sheet is foldable over the edge of the first vehicle surface such that the base member generally conforms to the first vehicle surface allowing the first securing device to secure the base member to the first vehicle surface.

* * * * *